US011098970B2

(12) United States Patent
Elftmann, Jr.

(10) Patent No.: US 11,098,970 B2
(45) Date of Patent: Aug. 24, 2021

(54) ADJUSTABLE PULL TRIGGER ASSEMBLY

(71) Applicant: Arthur J. Elftmann, Jr., Glendale, AZ (US)

(72) Inventor: Arthur J. Elftmann, Jr., Glendale, AZ (US)

( * ) Notice: Subject to any disclaimer, the term of this patent is extended or adjusted under 35 U.S.C. 154(b) by 0 days.

(21) Appl. No.: 16/943,964

(22) Filed: Jul. 30, 2020

(65) Prior Publication Data

US 2021/0033366 A1 Feb. 4, 2021

Related U.S. Application Data

(60) Provisional application No. 62/880,607, filed on Jul. 30, 2019.

(51) Int. Cl.
*F41A 19/16* (2006.01)
*F41A 19/13* (2006.01)

(52) U.S. Cl.
CPC ..... *F41A 19/16* (2013.01); *F41A 19/13* (2013.01)

(58) Field of Classification Search
CPC ..... F41A 19/17; F41A 19/16
See application file for complete search history.

(56) References Cited

U.S. PATENT DOCUMENTS 3,550,301 A * 12/1970 Shesterikov ..... F41A 19/16 42/69.01
4,910,903 A * 3/1990 Senfter ..... F41B 11/723 42/69.02
6,978,568 B2 * 12/2005 Jewell ..... F41A 19/16 42/69.02
7,047,685 B2 * 5/2006 Diaz ..... F41A 19/16 42/69.02
8,250,799 B2 * 8/2012 Duperry ..... F41A 19/16 42/70.04
9,046,313 B1 * 6/2015 Lutton ..... F41A 19/44
2011/0167696 A1 * 7/2011 Gangl ..... F41A 17/82 42/69.03

FOREIGN PATENT DOCUMENTS

EP 0122220 A1 * 10/1984 ..... F41A 33/00

* cited by examiner

*Primary Examiner* — Reginald S Tillman, Jr.
(74) *Attorney, Agent, or Firm* — Law Offices of Lisa & Lesko, LLC; Justin Lesko, Esq.

(57) ABSTRACT

Adjustability of trigger pull force is enable by the use of a spring interfacing with a trigger shoe counterweight. The spring force is adjustable by use of a set screw interfacing with the spring. A pivot arm member acts between a trigger shoe counterweight and a firing pin release arm to fix the ratio of trigger shoe pull force and firing pin release arm force.

7 Claims, 8 Drawing Sheets

ADJUSTABLE PULL TRIGGER ASSEMBLY

CROSS REFERENCE TO A RELATED APPLICATION

This application claims the benefit of Provisional Patent Application 62/880,607, filed Jul. 30, 2019, bearing the same title as this application. This earlier filed application is hereby incorporated by reference in its entirety.

BACKGROUND OF THE INVENTION

Field of the Invention

This invention is a trigger assembly that allows the pull force of a trigger used in a Remington 700 style rifle to be adjusted by the user.

This trigger is an adjustable pull force modular trigger assembly for first use in a rifle or in replacing an existing trigger assembly of a rifle. The adjustable force trigger can be used in rifles such as the Remington 700 series style rifles or in the many iterations of 700 style rifles made around the world. The adjustable pull force trigger can be shipped with a new rifle or can be used as a replacement of the stock or original equipment trigger assembly carried in the receiver portion of a rifle.

Description of Known Art

The trigger presented in this invention is a modular trigger that is used primarily in rifles, such as the Remington 700 series center-fire rifles and similar rifles by other manufacturers.

It is known to use modular replacement trigger assemblies to replace the stock trigger assemblies on various rifles. Manufactures of drop in triggers include, among others, CMC Triggers, Timney Triggers, and High Performance Firearms Accessories.

It is known that stock triggers in many retail rifles have triggers with accuracy-robbing characteristics, such as, but not limited to, inconsistent pull force, heavy or light pull force. As will be addressed further on, the drop-in modular trigger presented here provides a trigger that enhances the accuracy of a rifle by allowing the shooter to adjust the pull force of the trigger.

The known triggers will usually have a structure that yields a one-to-one ratio between the trigger shoe, including its integral counterweight, and the firing pin release arm which are directly and functionally associated.

A version of a trigger similar to the trigger presented herein, but lacking the adjustability function is shown, in U.S. patent application Ser. No. 14/492,065, herein incorporated by reference.

BRIEF SUMMARY OF THE INVENTION

The present invention provides a device that allows the adjustability of the "pull force," that force applied to a trigger of a firearm to cause the sear, striker, or hammer to release.

An advantage of this trigger is that there is a more than one-to-one relationship between the trigger shoe and the firing pin release arm as is common in triggers known in the field today.

It is an advantage to many shooters to have the ability to adjust the pull of the trigger in the weapon they are using. Adjustability may be based on personal preference, the type of shooting being done, the environment the weapon is being used in, as well as numerous other reasons for having adjustability in a trigger.

One advantageous aspect of the adjustable pull trigger of this invention is that it is adjustable from less than two ounces to over five pounds of trigger pull.

A further advantage of this trigger is that it incorporates several bearings at critical locations that make the trigger smoother and with less friction than known triggers.

One other advantage is that this trigger is impervious to undesirable changes in pull force due to circumstances that may occur in the field. For instance, in some situations with some known triggers, slamming the bolt home hard in a rapid fire situation, may cause the preselected pull force to change a considerable amount, in the range of several pounds.

Another advantageous element of this trigger is that it has an oversized, ambidextrous, safety knob and an adjustable trigger shoe.

In one embodiment of the invention there is an internal bolt release feature and in a second embodiment the bolt release is not provided.

Another advantage to this invention in that it can be installed at the manufacturing facility of a weapon manufacturer without the need for retooling of the receiver. Thus, there are no added machining costs of the receivers for manufacturers to incorporate the adjustable pull trigger in their receivers. This adjustable pull rigger will install in the standard cavity of a lower just as any trigger normally to fitted to the rifle would be installed. This gives the manufacturer the ability to offer triggers of various performance capability carried in a standard receiver from the factory. Various trigger designs may offer premium fit and finish down to utilitarian fit and finish for a lower price.

Another advantage offered by this adjustable pull trigger is that a person or persons assembling a rifle from component parts can fit this trigger in the receiver that she or he is using for the assembly without a need to have a special receiver acquired or special machining to accommodate this adjustable pull trigger. You don't have to be a gunsmith to fit this trigger to a 700 series style rifle.

It is also an advantage of this adjustable pull rate modular trigger is that it allows the shooter to lower the trigger pull effort rate to provide for single precision shots from a rifle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the drawing figures wherein.

Elements depicted in the figures are illustrated for simplicity. They are presented to illustrate the invention to assist in an understanding thereof. The figures are not necessarily rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

It should also be pointed out that the front of the trigger assembly is the direction that finger contacting portion of the trigger faces. The back or rear of the trigger assembly is the direction that the trigger is pulled when being fired. That is, the trigger is pulled back when being fired. The trigger is generally mounted such that the trigger is pointed away from the lower receiver in a downwardly facing direction as is usual.

As mentioned above, this invention has to do with rifles and particularly the removable trigger assembly carried in the receiver of a Remington 700 style rifle. This modified trigger assembly may replace similar trigger assemblies that don't have the adjustable pull feature and/or the bolt release feature as this adjustable trigger does. As a reference to triggers known today this trigger has more parts. But the parts used, such as bearings and components related to a pivot arm, make the trigger smoother, better able to hold an adjustment, and more predictable in actual operation. The construction of the trigger, where the cover plate is press fit on to the trigger housing and all bearings and bearing axles or bearing centers are press fit in into position takes unnecessary tolerance "slop" out of the trigger assembly.

Figure 1:
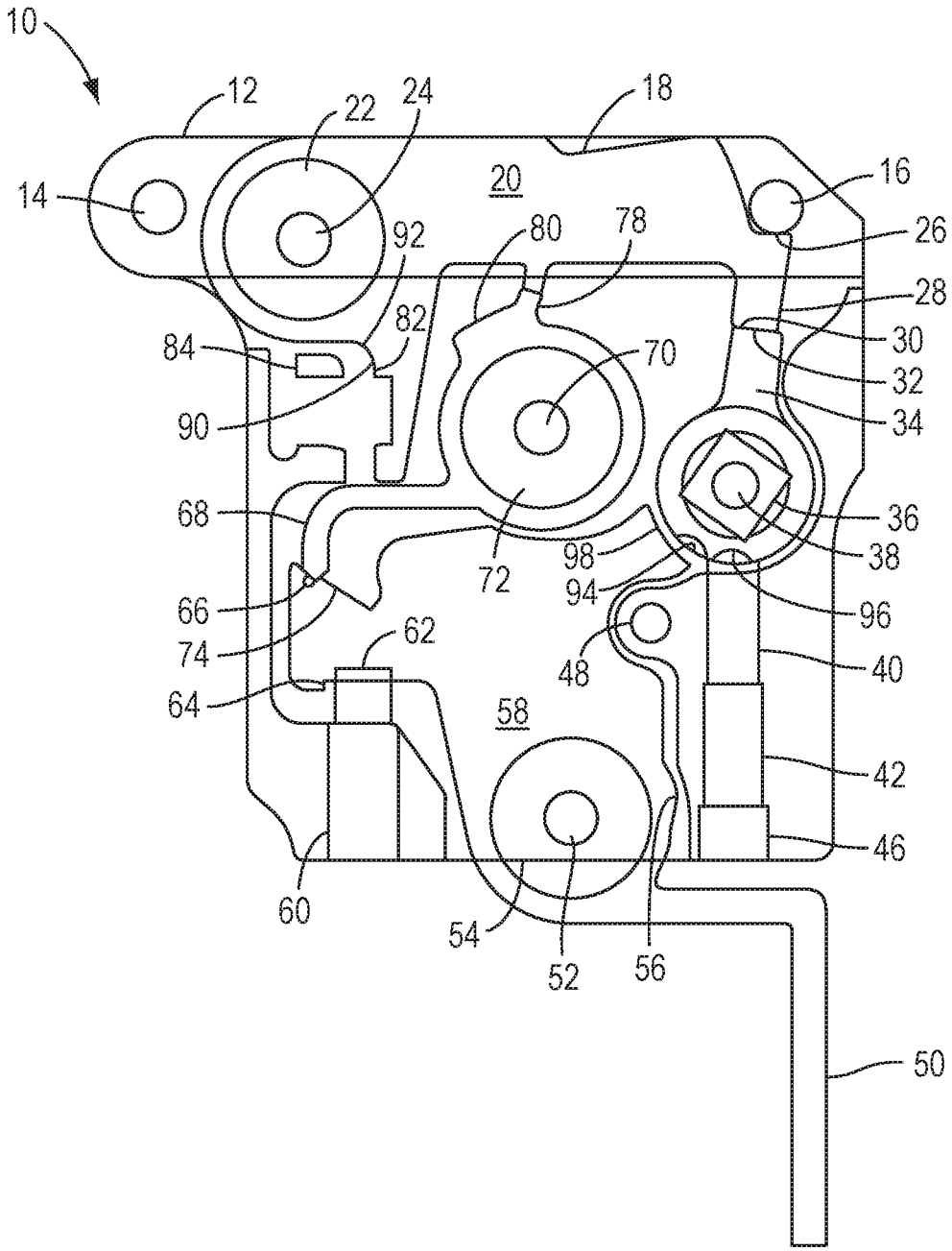
FIG. 1 shows the adjustable pull trigger having one side plate removed to show the internals of the trigger.

Looking at FIG. 1 most of the features and parts can be understood from studying this figure. However, before looking at each part in the trigger, it should be pointed out that one important distinction between this trigger and known triggers is that the illustrated and included parts of this trigger between the firing pin release arm and the shoe counterweight don't exist in other state of the art triggers. Other triggers just have a connection between the shoe counterweight and the firing pin release arm. Furthermore, other triggers don't use bearings to the extent and type as found in this trigger.

In FIG. 1, the adjustable pull trigger is generally shown as item 10. Element 12 is the housing 12 of the trigger assembly and is provided with a first aperture 14 and a second aperture 16. These two apertures are retention points to accept pins that will hold the trigger in the receiver or action of the rifle. Firing pin interface surface 18 is formed in the firing pin release arm 20 which is rotationally carried on a first bearing 22, centered on a bearing pivot point 24 supported in the housing of the trigger 12. The firing pin release arm 20 has a recess 26 for contacting, as a stop limiter, the pin that would pass into the second aperture 16 that hosts the pin used to retain the trigger assembly in the receiver.

An ambidextrous safety is provided in the trigger. It is designed to be operated either from the left side of trigger or the right side of the trigger depending on the preference of the operator. The safety has as lever arm 86 that is retained on the safety arm mount 36 by the use of a fastener that threads into the threaded hole for the safety lever attachment 38 from either the left side or the right side of the trigger frame. The safety lever arm 86 can be moved from one side of the frame to the other side of the frame easily by the trigger installer moving the fastener and lever arm from one side to the other side of the trigger housing 12.

An extension 28 of the firing pin release arm has a surface 30 that will contact a safety interface surface 32 of a safety plinth 34 which is part of the safety mechanism. The safety includes a safety lever arm mount 36 integral with the safety plinth 34. The safety is rotatably carried in the housing 12 around a threaded hole 38 for attachment of the safety lever. A first safety detent recess 94 and a second safety detent 96 are formed in the safety arm mount on the mount generally opposite the location of the safety plinth 34 of the safety. These detent recesses 94 and 96 will interface with a safety detent 40 including a ball 97 or, alternatively, an element having a spherical shaped surface, to interface smoothly with the detents 94 and 96 formed in the safety. The ball 97 is spring-loaded by means of a spring carried in a spring retaining bore 42 with the spring retained in the bore by means of a set screw threaded into a threaded portion 46 of the spring retaining bore 42. When the safety is engaged the safety detent ball 97 will interface with the first safety detent 94 and when the safety is disengaged the detent ball 97 will interface with the second safety detent 96. A portion 98 of the housing 12 hosts a threaded aperture 48 provided to accept a fastener to retain the right-side cover plate to the housing 12.

A trigger bar or shoe 50, which as shown in other figures normally includes the finger interface aspect of the trigger, also referred to as a trigger shoe, is pivotally carried on a bearing pin 52 which locates a second bearing 54 interfacing with and integral with a shoe counterweight 58. There is a small gap 56 between the shoe counterweight 58 and the housing 12.

Note that there are three bearings in this trigger. These bearings are press fit into the component they are associated with and each bearing is centered on a pin that is press fit into the trigger housing and the pins are ultimately press fit into the housing cover when the trigger is assembled.

Returning to FIG. 1, the shoe counterweight contacts a second spring 62 urged into contact and adjustable by means of a set screw 60 screwed into a threaded hole in the trigger body 12. This assemblage of the set screw 60, the spring 62, both carried in a bore having a threaded portion to receive the set screw 60 are adjustable to fine tune the pull force necessary to activate the trigger and thus fire the host rifle. Adjusting the set screw 60 into the threaded bore will urge the spring to increase the spring load on the adjacent surface of the shoe counterweight 58 in a clockwise direction making the trigger pull higher. Moving set screw 60 outwardly in the threaded bore will urge the spring to decrease the spring load on the adjacent surface of the shoe counterweight 58 in a clockwise direction making the trigger pull lighter. The setscrew 60 is adjustable using an Allen wrench as is commonly used with set screws.

The following structure is not known to exist on earlier triggers. That is every component between the trigger shoe counterweight and the firing pin release arm as is found in this invention distinguish it from known triggers use on Remington 700 style rifles.

The firing sear 66 interfaces with a pivot arm firing sear 74 that is mounted on a third bearing 72 carried on a third bearing pin 70. A pivot arm member 68/78 is part of the structure carried on the third bearing. (Item 80 is not necessary in the embodiment discussed herein.) The pivot arm 78 is in contact with a projection extending downwardly from the firing pin release arm 20 until the trigger is activated and the firing pin release arm 20 moves upwardly. The pivot arm 68/78 releases the firing pin release arm 20, allowing it to move downwardly, when the trigger shoe is pulled to fire the rifle.

In one embodiment of the invention the ratio of trigger pull force to firing pin release is approximately six-to-one. The ratio can reasonably be two-to-one, which is an improvement over the one-to-one of standard triggers, to even twelve-to-one, which would be higher than normally desired. To change the ratio a proper ratio pivot arm member would be installed in the trigger housing.

In operation when the trigger shoe 50 is pulled by the shooter the pivot arm 68 will be released from its position in contact with the pivot arm firing sear and will rotate counterclockwise into the void area of the shoe counterweight. This will allow the pivot arm element 78 to disengage from its contact with the downward projection on the lower edge of the firing pin release arm 20. Assuming the safety is off, safety plinth 34 rotated counterclockwise, the firing pin release arm is free to move.

A reset spring is carried in a cavity which is a reset spring housing 82 formed in the housing 12. The reset spring is a light spring and only needs to be strong enough to urge the downwardly extending portion of the firing pin release arm 20 to contact the left side of the pivot arm member 68 generally horizontally from the third bearing pin 70. The reset spring will exert pressure on the downwardly extending arm of the firing pin release arm 20. A reset spring housing 90 is proximate the firing pin release arm 20 when the trigger is ready to fire. Item 84 is only a machining artifact.

Many of the trigger elements are shown in FIG. 1. For the most part the other figures show the safety lever and small nuances of alternative structures that are slightly different from what is shown in FIG. 1. These alternative embodiments don't deviate from the intent of the device being an adjustable pull force trigger.

Figure 2:
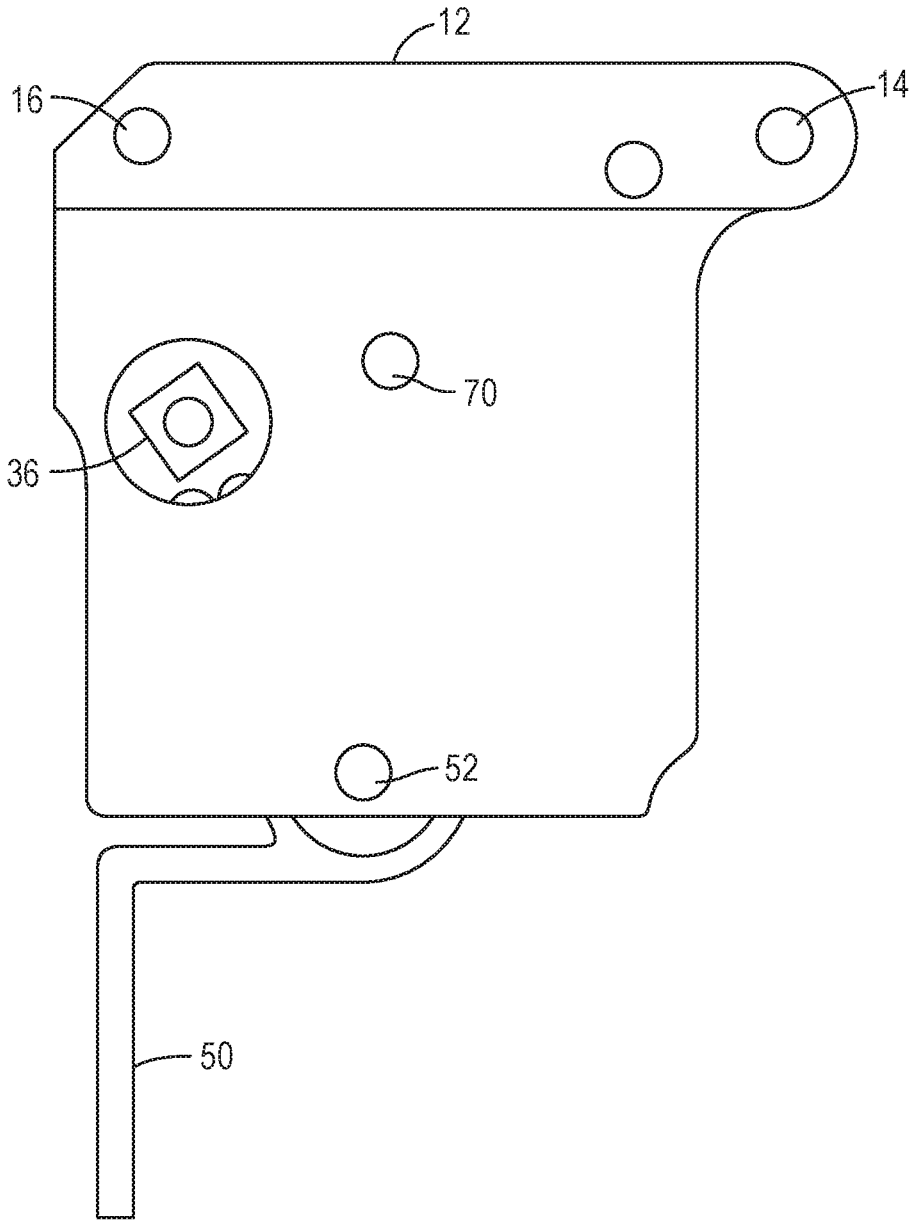
FIG. 2 is a view of the housing portion of the trigger assembly.

FIG. 2 is the back side of the assembly shown in FIG. 1. In essence it is FIG. 1 flipped over. The housing is 12 and it has the first and second apertures 14 and 16 for receiving mounting pins to hold the trigger in the action or receiver of the host rifle.

FIGS. 3-6 show the trigger assembly with the firing pin release arm 20 above the top margin of the housing 12. This is not the normal position of the release arm 20 but it can go to that position in these figures as the trigger retention pin positioned in the second aperture 16 is not in place to restrain the firing pin release arm 20 as it is shown in FIG. 1 since the trigger is not installed in a receiver.

Figure 3:
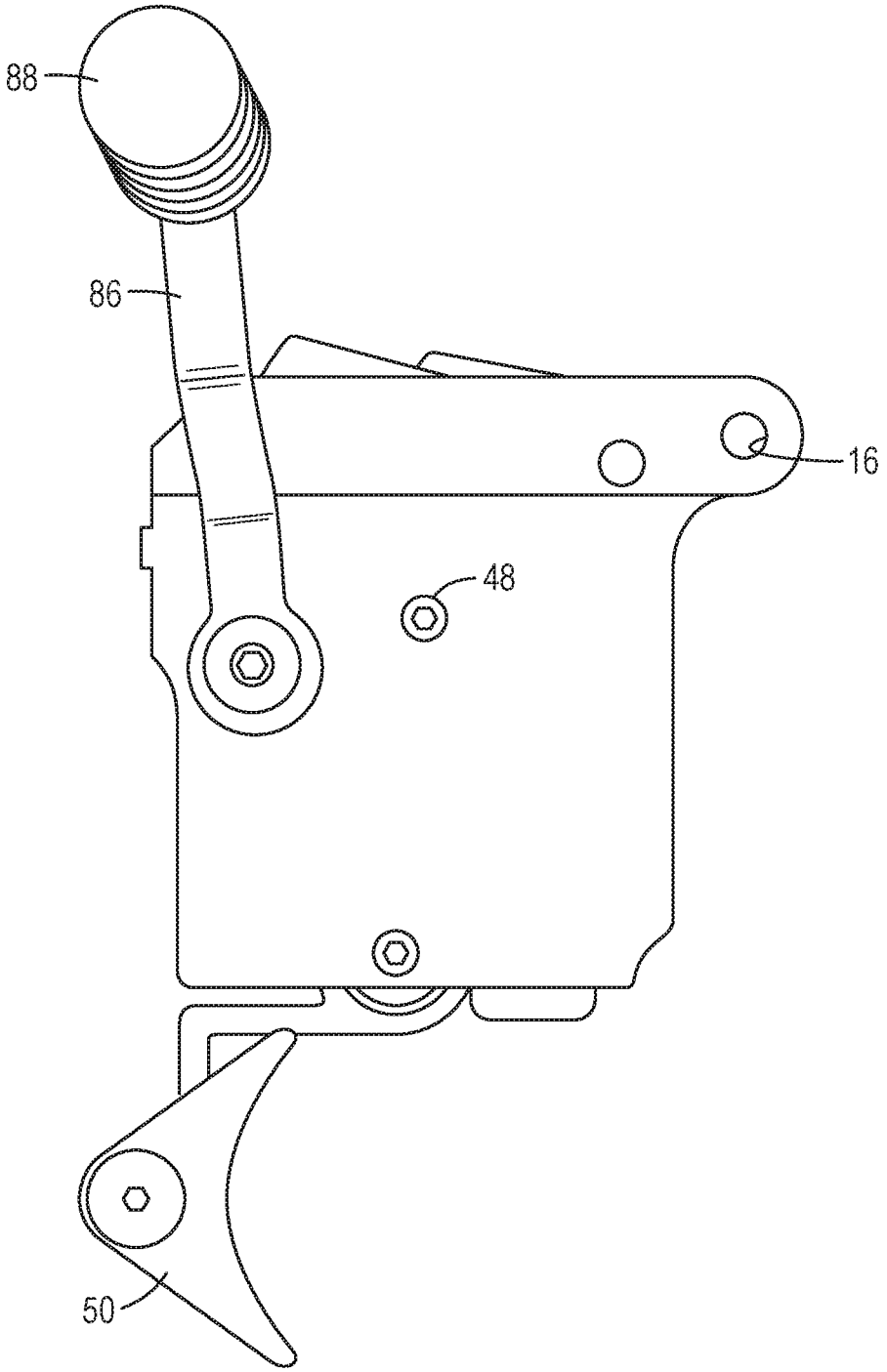
FIG. 3 is a photograph of a complete adjustable pull trigger showing the trigger shoe or trigger contact element pivotally mounted to the extending trigger bar or shoe element and the safety lever of the trigger.

FIG. 3 is provided to show the safety arm or lever 86 and the digit engaging cylinder 88 attached thereto.

Figure 4:
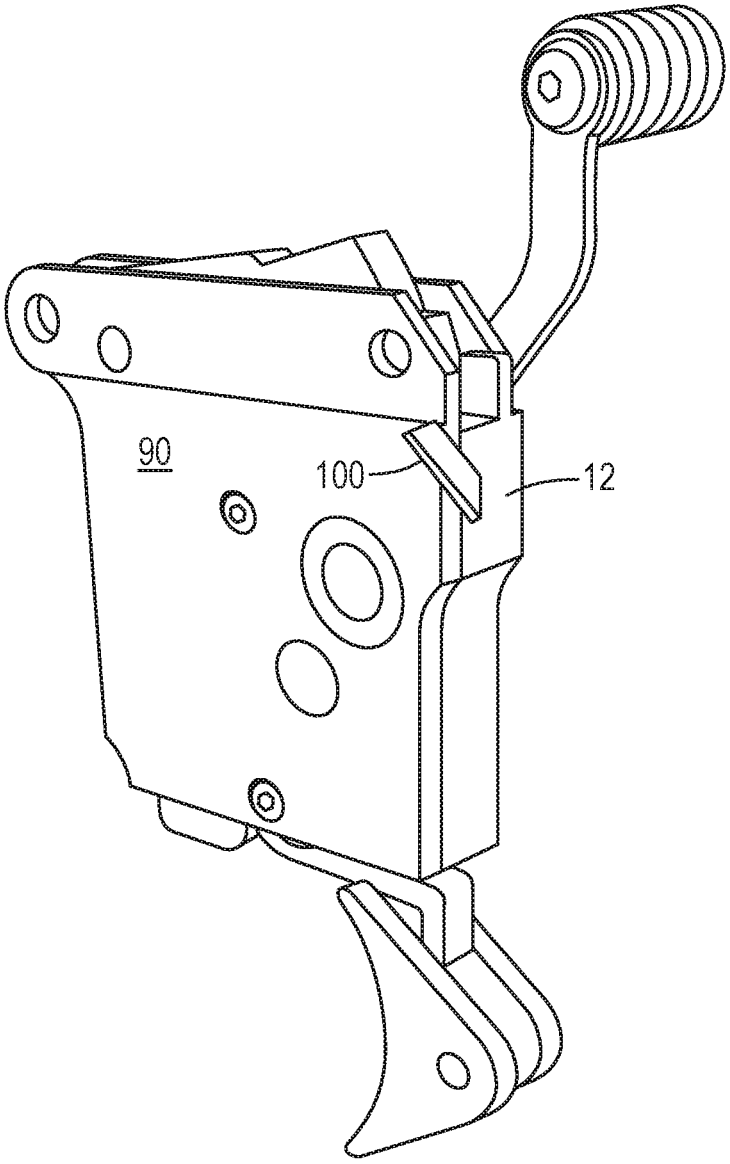
FIG. 4 is the same trigger as shown in FIG. 3 showing the opposed side of the trigger.

FIG. 4 shows the opposite side of the trigger assembly that is shown in FIG. 2. Here the cover plate 90 is shown in position on the body or housing 12. This cover plate is not shown in FIG. 1 as it is removed to show the internal components of the trigger assembly. Shown for the first time is the tang 100 of the bolt release 102 that is clearly shown in its entirety in FIG. 7.

Figure 5:
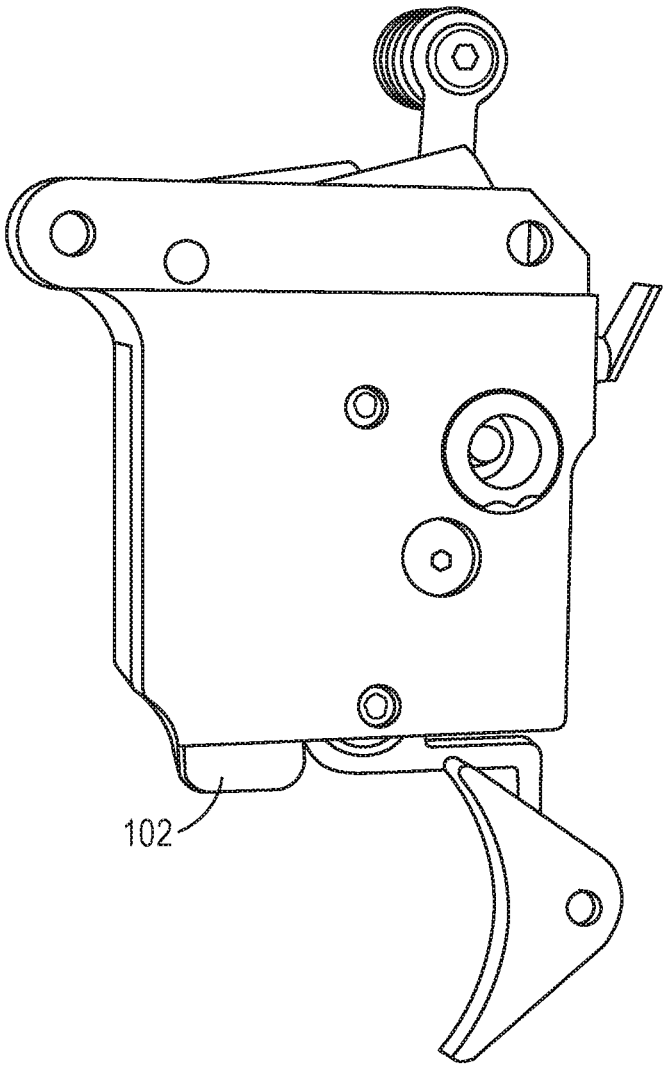
FIG. 5 is the trigger of FIG. 4 in a side elevation view.

FIG. 5 is the trigger of FIG. 4 flipped over. A portion of the bolt release 102 can be seen in this figure.

Figure 6:
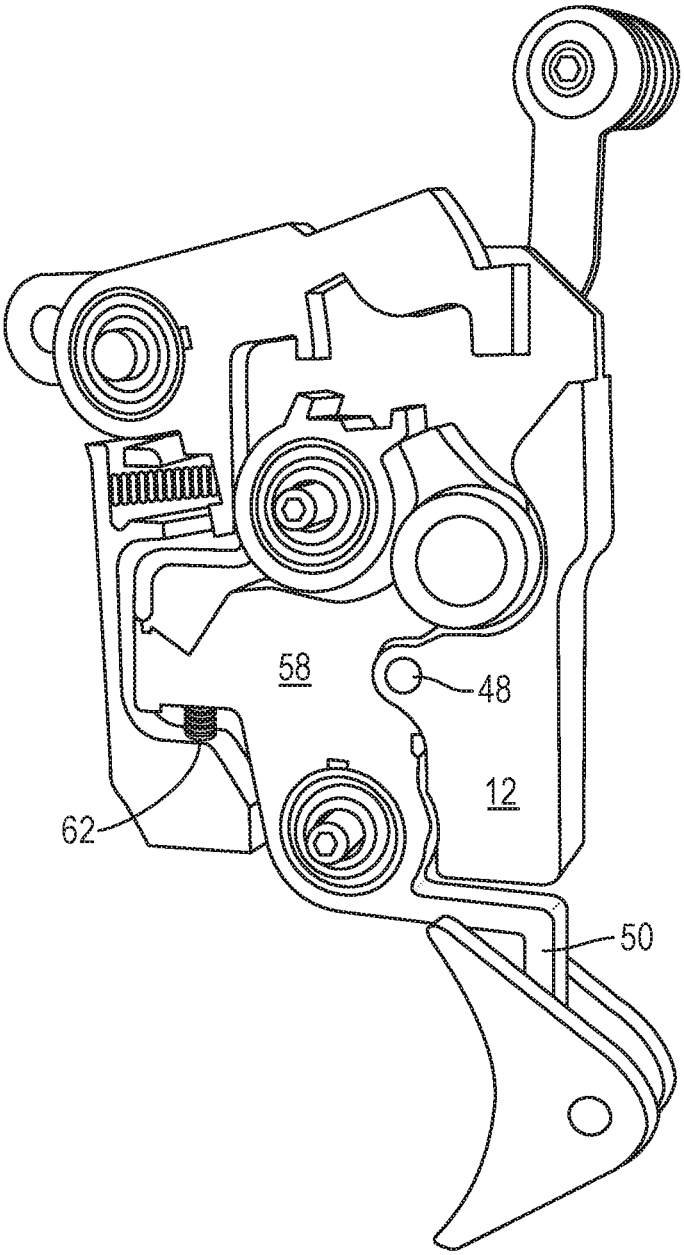
FIG. 6 is the trigger of FIG. 4 with a side plate removed to show the interior of the trigger.

FIG. 6 is similar to FIG. 1 but is a slightly different configuration. It operates the same as the embodiment of FIG. 1 including the second spring 62 of the trigger pull adjusting mechanism. Although many of the components are slightly different from those of FIG. 1 the function of each part relative to the part it interacts with is similar if not the same.

Figure 7:
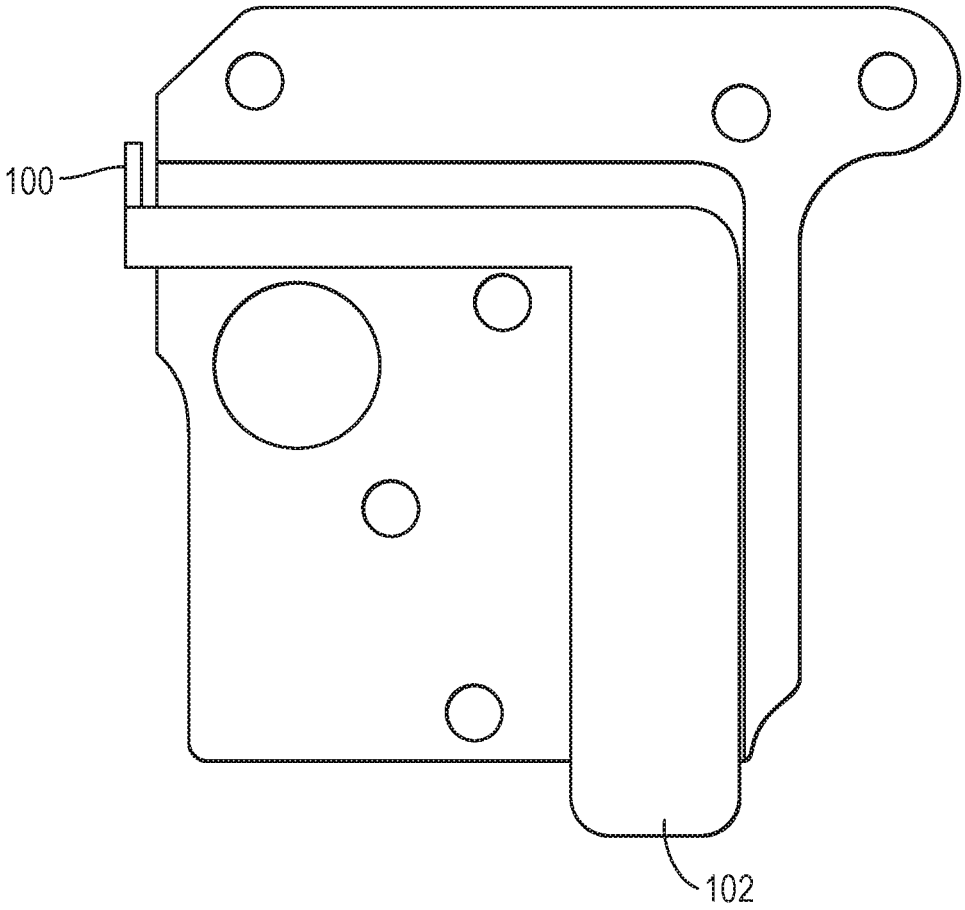
FIG. 7 shows the bolt release on a milled cavity on the interior of a side plate.

FIG. 7 is provided to show the bolt release 102 and how it is nested in the housing of the device. It is capable of being slid upwardly in the host cavity such that the tang 100 if urged upwardly to release the bolt on the host rifle. The bolt release aspect of the adjustable trigger is an alternative embodiment and the bolt release as shown in this figure and FIG. 8 need not be incorporated into an alternative version of the adjustable trigger.

Figure 8:
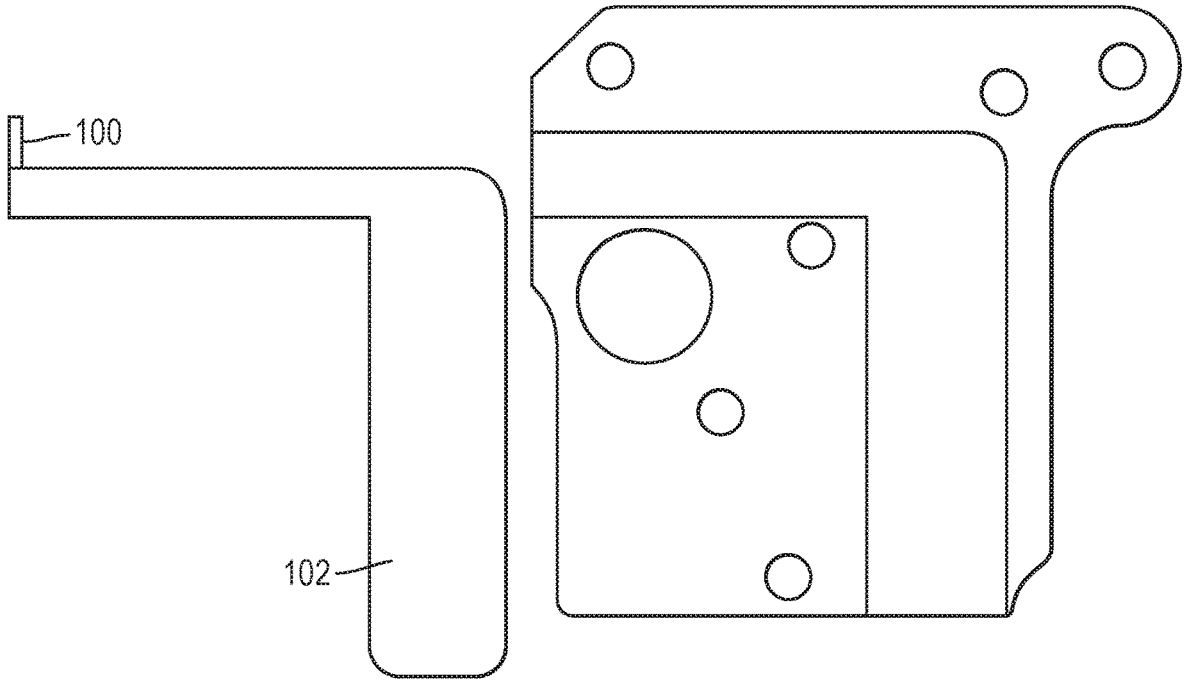
FIG. 8 is similar to FIG. 7 with the bolt release spaced apart from the side plate in which it is usually carried.

FIG. 8 is the device as shown in FIG. 7 with the bolt release 102 space apart from the host element.

It is preferred to cast, machine, or fabricate the drop-in modular adjustable pull force trigger assembly from aluminum with steel or other hard metal elements in wear zones. The inventor also contemplates making the drop-in modular trigger assembly from non-aluminum metals, such as, but not limited to steel, or from non-metallic materials such as high-performance plastics or other polymer-based materials. Metal inserts may be necessary at wear points when non-steel materials are used to form the trigger.

In summary, in one preferred embodiment of the invention, an adjustable pull force trigger for use in a rifle includes a housing having an interior portion and a through bore formed in the housing. There is a bearing pin press fitted in the through bore and a bearing press fitted on the bearing pin. A pivot arm member press fitted on the bearing, there are two important elements of the pivot arm member. These are the horizontally extending pivot arm 68 and the pivot arm projection 78 that extends vertically to interface with a projection on the firing pin release arm 20 rotatably carried in the housing. The pivot arm member 68/78 also has a body portion that encircles the third bearing 72. The trigger also has a trigger shoe counterweight rotatably carried in the housing which is spaced apart from the firing pin release arm. This results in the pivot arm member 68/78 to be positioned between the firing pin release arm 20 and the trigger shoe counterweight 58.

In further summary, the invention is an adjustable pull force trigger for use in a weapon. The mechanism for adjusting pull force comprises the housing having a threaded aperture; a trigger shoe including a shoe counterweight rotatably mounted in the housing; a spring carried inside the threaded aperture of the housing, the spring having a first end and a second end, the first end in contact with the shoe counterweight; a set screw screwed into the threaded aperture, the set screw in contact with the second end of the spring; wherein the set screw is screwable or unscrewable in the threaded aperture to exert or relieve pressure on the spring and therefore on the shoe counterweight.

One aspect of the invention to be noted is that the trigger presented herein, due to the parts between the shoe counterweight 58 and the firing pin release arm 20, and specifically, the pivot arm member 68/78 configuration, there is an adjustable pull force trigger for use in a rifle comprising a pivot arm member having a ratio of firing pin release arm release value to trigger shoe pull value greater than one-to-one. The range of the ratio can be approximately two-to-one to approximately twelve-to-one. In one user comfortable embodiment the ratio is approximately six-to-one.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments defines or constrains the invention.

What is claimed is:

1. An adjustable pull force trigger for use in a rifle comprising;

a housing having a threaded aperture formed therein;

a trigger shoe including a trigger shoe counterweight and a firing sear;

a spring carried inside the threaded aperture of the housing, the spring having a first end and a second end, the first end of the spring in contact with the trigger shoe counterweight;

a set screw screwed into the threaded aperture in the housing, the set screw in contact with the second end of the spring carried in the threaded aperture; wherein the set screw is screwable or unscrewable in the threaded aperture to exert or relieve pressure on the spring and therefore on the shoe counterweight and ultimately on the trigger shoe thereby effecting the trigger pull force;

a firing pin release arm configured to cause the rifle to fire when released, wherein the firing pin release arm includes a downward projection;

a pivot arm member that rotates on a bearing within the housing and acts as an interface between the trigger shoe and the firing pin release arm, the pivot arm member including (1) a top projection in contact with the downward projection of the firing pin release arm before the trigger shoe is pulled and (2) a bottom projection in contact with the firing sear of the trigger shoe before the trigger shoe is pulled;

wherein the trigger shoe is configured to release, when pulled, the bottom projection from its position in contact with the firing sear, thereby causing the pivot arm to rotate, disengage the top projection from the downward projection of the firing pin release arm, and release the firing pin release arm.

2. The trigger in accordance with claim 1 wherein the housing of the adjustable pull force trigger has a safety arm mount including a threaded hole, further comprising:

a safety lever and a fastener for attaching the safety lever to the safety arm mount, the fastener screwed into the threaded hole to retain the safety lever arm.

3. The trigger in accordance with claim 1, wherein the pivot arm member is positioned such that a ratio of firing pin release arm release value to trigger shoe pull force value is greater than one-to-one.

4. The trigger in accordance with claim 1, wherein the bottom projection of the pivot arm member includes a horizontal portion projecting from the pivot arm and a vertical portion in contact with the firing sear of the trigger shoe before the trigger shoe is pulled.

5. The trigger in accordance with claim 1, wherein the firing pin release arm rotates on a second bearing within the housing.

6. The trigger in accordance with claim 5, wherein the trigger shoe rotates on a third bearing within the housing.

7. The trigger in accordance with claim 3 wherein the ratio is approximately six-to-one.

* * * * *